United States Patent [19]

Giros

[11] 3,951,322

[45] Apr. 20, 1976

[54] METHOD AND APPARATUS FOR THE TREATMENT OF FLEXIBLE MATERIAL

[75] Inventor: Marcel A. P. Giros, Ancerville, France

[73] Assignee: Societe Meusienne de Constructions Mecaniques, Ancerville, France

[22] Filed: May 18, 1973

[21] Appl. No.: 361,616

[30] Foreign Application Priority Data

May 24, 1972 France ..... 72.19235

[52] U.S. Cl. ..... 226/119; 242/55.01

[51] Int. Cl.[2] ..... B65H 17/42

[58] Field of Search ..... 226/168, 188, 118, 42, 226/43, 119; 242/182, 183, 184, 79, 82, 55.01

[56] References Cited

UNITED STATES PATENTS

| | | | |
|---|---|---|---|
| 2,729,446 | 1/1956 | Morrill | 242/55.01 |
| 3,107,455 | 10/1963 | Gloor | 226/200 X |
| 3,439,851 | 4/1969 | Rum | 226/168 X |
| 3,460,372 | 8/1969 | Kilgour | 242/55.01 X |
| 3,462,979 | 8/1969 | Ziegler | 242/55.01 X |

*Primary Examiner*—Richard A. Schacher
*Attorney, Agent, or Firm*—Otto John Munz

[57] ABSTRACT

An apparatus including combined means to control the size of helicoidal loops of an elongated flexible material and the linear speed of said material carried by horizontal rotary shafts and dipping into a treating agent inside a volume: the material inlet speed controls the speed of one of the shafts; it is positively driven up at the outlet; the effective linear speed inside the volume and the size of the loops are controlled by combined drives using different frictional properties of the material against the shafts and one wall sector of the volume, suitably covered for short temporary stopping contacts.

11 Claims, 7 Drawing Figures

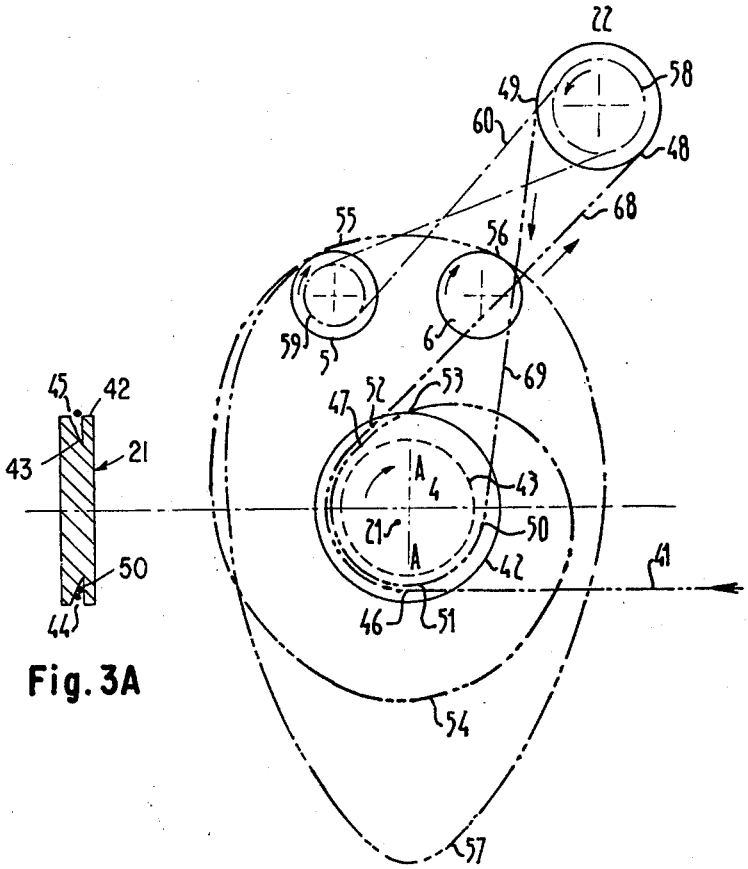
Fig: 3
Fig. 3A
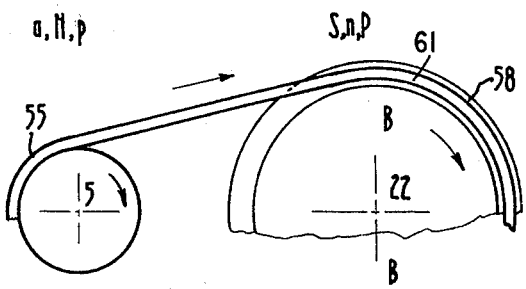
Fig: 4
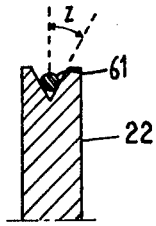
Fig. 4A

METHOD AND APPARATUS FOR THE TREATMENT OF FLEXIBLE MATERIAL

BACKGROUND OF THE INVENTION

1. Field of the Invention

The invention applies to the treatment of a flexible material such as metallic band, tube, wire or coil. It is concerned with an apparatus where the flexible material travels through a treatment volume in the shape of a helix so as to dip into a treating medium in the volume. This finds application in the treatment of surfaces of part-worked materials in metallurgy, such as chemical or electrolytic pickling, deposition, or so.

2. Description of the Prior Art

Examples of such apparatus are seen in above quoted U.S. patents wherein a flexible material such as a metallic strip or wire passes continuously through a tank or treatment volume following a helix-shaped path, this shape being imposed on said material by a set of driving and bending cylinders or rollers; the helical progression is made screw-wise as a result of the combined effects of one or more horizontal shafts carrying this helix and transmitting to same their rotary movement, and on the other hand, by a fixed horizontal comb of which teeth gear in the loops of said helix. The carrying shafts movement transmission is effected in a fixed ratio by the motor powering the input drive of material.

This makes for almost perfect functioning in normal working, although the treatment itself, which particularly has the effect of lessening or increasing the roughness of the material surface, causes a change, between inlet and outlet, of the frictional relationship between the material and the carrying shafts providing same its movement; this change is revealed by the development of a few loops of the helix relative to others, the loops where the material is the smoothest slipping the most and as a consequence getting longer than the others. As a result of this, the adjustment of the linear speed of the material inlet by reference to the size of sample loops, left for that purpose upstream of the treatment volume, is somewhat inaccurate because the control is not sufficiently representative of the behaviour of the helix inside the volume; in the same way the adjustment of the linear outlet speeds of the material by reference to the size of sample loops left for that purpose downstream of the treatment volume, is likewise imperfect. Mere amalgamation of these two adjustments is not enough to reach perfection. In addition these adjustments require the material to go helically past the inlet or outlet wall of the volume, as the case may be, which may imply an increase in pitch of the helix at that loop due to the fact that it must be wider than the wall which the material is passing over, which is harmful to the stability of the helix. But above all, experiment has shown that during starting up and slowing down of the material progression, the latter slips on the drive means at the inlet, the movement of which, transmitted to the carrying shafts, results in a slipping of the shafts on all the loops of the material; these slippings are noxious as they can mark the material locally. It should also be deemed that the loops of discrepant sizes also have discrepant contact times with the treating agent.

SUMMARY OF THE INVENTION

The invention aims to obviate or diminish these drawbacks. It applies to an apparatus for treating flexible material known per se and including means for giving it the shape of a helix, means for making it progress continuously inside a treatment volume by means of at least a pair of shafts which carry and drive the loops of the helix, each pair of shafts having an upstream shaft over which each loop first passes and a downstream shaft over which each loop afterwards passes, and drive means of the said shafts giving them a rotary movement related to that of the helix and imposing on the downstream shaft a greater peripheral speed than the upstream shaft speed.

An important feature of the invention is a combination of appropriate drive means to govern the linear speed of the material, positively controlled at the outlet, to the mean speed effectively transmitted to same by the carrying shafts.

Another feature of the invention is the achievement of controlling the size of the helix loops through short temporary stopping contacts, between said loops and a wall sector of the volume adapted for such an action. Such contacts well be called herein after "stopping contacts."

An optional feature of the invention is a provision for solving the problem of the material having to pass over transverse partitions of the volume when in a helix, by hurling back the treating agent by blowing the same, which eliminates the need for a separate rinsing bath (which would have been entered by the material as a helix).

Resuming discussion of the above points and dealing first with the steady fitting the loop dimensions, experiments with working prior art apparatuses has shown that a loop which, for reasons inherent in the treatment or whatever may be, increases in size and touches the bottom wall will stop, due to the delaying effect of the material rubbing the fixed wall which cannot be overcome through the driving effect of the carrying shafts; this stoppage is transmitted back upstream up to the entry into the volume. If the material has been somewhat rigidified by a transverse cambering, the loop is tightened by its driven upstream portion to rise above the carrying shaft which can no longer drive it; in addition this loop is no longer supported so it can twist to lie in the longitudinal direction of the treatment volume and can, as a result, get entangled in the neighboring loops.

It can thus be seen that the rigidity of the loops is not a factor of regular progression. It is preferred according to the present invention to do away with it, for example by giving the bands no transverse cambering. This eliminates the propulsive effect which is achieved from one loop to the next, in the case of rigid material and allows each loop to take up its catenary equilibrium position under its own weight inside the volume. In this way the part of each loop submerged in the treatment agent can be increased of about 30%, provided that the depth of the volume beneath the carrying shafts is built accordingly.

Another matter disclosed from prior art experiment is as follows: a loop can only stop momentarily, if it is pulled positively by the loop immediately downstream of it. In starting again, the said loop will have a size somewhat smaller than that allowed by the walls of the treatment volume, and the same happens, in an uniform module to any upstream following loop. Thus, a stopping contact with a wall sector of the volume acts as means which equalize the development of the loops to the maximum amount allowed by the volume and this brings about an optimum use of the said volume.

As frequently the stopping of one loop does not have time to be transmitted, loop by loop, right to the entering loop before the whole progression starts again, quite a number of jolts of this sort are absorbed by the material stored inside the treatment volume, and a reduction results in the number of manual or automatic interventions needed to stop or restart the drive device which introduces the material at the entrance of the volume, which enables an appreciable increase of the mean speed of progression and in consequence to use the treatment capacity of the apparatus at best.

Making these stopping contacts effective systematically implies using appropriate materials, not only in connection with the covering of the carrying shafts but with the covering of a wall sector of the volume; in fact, it is necessary that the stopping contact of the loops shall not cause too great a wear on these coverings or a deterioration in the treated material; furthermore where the covering of a wall sector of the volume is concerned, it is necessary that it should resist possible corrosion by the treatment agent. These materials have a known use which has been confirmed by experiment and they give complete satisfaction. There may be used, for example, a covering of polyvinyl resin on the shafts and a covering of slabs of lava on a wall sector of the volume.

But the principal feature is the means employed to carry out the drive of the shafts. The variables are the mean linear speed of the material, the peripheral speeds of the driving or driven members, as well at the entrance and during passage through the volume and at the outlet, it being understood that the positive drive (that is to say without slippage) of the material at the outlet is not necessarily at constant speed and can be intermittent and include halts. This possibility allows direct drive by a subsequent machine for further transformation of the treated material (for example a wire-drawer of pickled steel wire), or merely the rolling up of this treated material onto reels for temporary storage. The adaptation of the curvature of the material to its next intended use at the outlet can be carried out by a pair of rollers with a bending or a counter-bending function provided with a transverse setting adjustment relative to the position of the main set.

Drive devices of the apparatus are a drive for the input of the material, the carrying shafts (at least one called the upstream shaft and at least one called the downstream shaft) and finally a drive for output or extraction of the material.

The material can, for example, be driven at the entry either by a set of cylinders or rollers for driving and bending or by a capstan provided with a satellite. In the first case, if the material is a band, the drive cylinders will have a flat rim; if the material is a tube, a wire or a coiled wire, the drive cylinders will have a rim with a round groove with a transverse radius of curvature greater than that of the material. In an advantageous arrangement, one of the cylinders or rollers transmits its rotation to the upstream carrying shaft through a keyed sprocket onto each of these two members and linked to the other by an endless chain, the ratio of the numbers of teeth of the sprockets being the same as that of the respective diameters of the members on which they are keyed, so that the peripheral speeds of the roller and the shaft shall be the same; this speed is also the linear speed of the driven material, whatever its thickness or diameter.

When driving by means of a capstan with free satellite, these two members have a rim that is either flat or grooved according to the material to be driven. It is then possible to drive the upstream shaft directly or indirectly by means of the material itself; in fact the position of the satellite can be chosen so that, passing over the upstream shaft before the first loop, the material envelopes over quite a large arc the periphary of this shaft in order to obtain an adequate frictional interaction; this is the general case for a band material. Even if the material, round wire for example, does not interact frictionally adequately with the upstream carrying shaft in spite of this arrangement, it may embrace a much greater arc around the satellite, always greater than 90°; it is therefore capable of driving this satellite and the latter is used as means for the indirect transmission of the linear speed of the material at the periphery of the upstream carrying shaft.

This can be done by keying onto the satellite and onto the upstream shaft, respectively, sprockets with a number of teeth ratio which is the same as that of the respective diameters of the satellite (taken at the root) and of the upstream shaft. The sprockets are linked by an endless chain. Strictly speaking, the linear speed of the material should be considered along the neutral line, which does not alter in length during the bending process, and which is half a thickness from the line of contact with the member over which the material is wound. As a result, if the band is very thick, the diameters of the satellite and of the shaft should be alike.

In the case of material round in section (wire or coiled wire), it is even possible to make constant the ratio between the angular speeds of the satellite and the upstream carrying shaft, independantly of the diameter of the material, and, as a result, to drive the latter by the former by means of two sprockets engaged by an endless chain, provided that the ratio of the number of teeth of the two sprockets is properly chosen, and that the satellite has an appropriately designed groove, which shifts the neutral line away from the base of the groove when the diameter of the material increases.

The advantages of driving the upstream carrying shaft directly by the material, or indirectly by means of a capstan and a free satellite, can be summarized up thus: the first loop of the helix of material is hung between the second and the third passage of the material over the upstream carrying shaft, the first passage taking place between the capstan and the satellite. Thus no complete loop of material has to pass over the entrance wall. In addition, when the material slides over the capstan or the satellite or even stops for a few moments on reaching its position of stopping contact with a wall sector of the volume when in a loop of maximum development, the peripheral speed of the upstream carrying shaft, since it is driven, is automatically adjusted to the actual speed of the material; there may even be complete avoidance of slippage between shaft and material as a consequence. In contradistinction, and without this arrangement, a condition of slippage could happen with a speed difference much higher than which is produced in normal working, which could lead to excessive wear.

Expediently, the downstream carrying shaft is driven by a d.c. independent motor, independently from the upstream shaft, from the material and from the output drive. According to another embodiment, with again an independently running downstream shaft, but increasing the automation of the whole, the downstream shaft, by means of an adjustable speed variator, is linked to a material input drive motor. Its peripheral speed is always greater than that of the upstream shaft; it thus applies on the portion of each loop situated between the upstream and downstream shafts a pulling action perpendicular to the parallel axes of the two shafts, which has the effect of stabilizing the position of each loop and of neutralizing the tendency which it could have to start yawing. Whilst remaining higher than the peripheral speed of the upstream shaft, the peripheral speed of the downstream shaft is adjusted so as to transmit to the material an actual mean speed equal to the output speed, taking account of slippage.

In addition, there is advantageously provided a comb with the essential function to separate each loop from the next by one of its teeth, and which must necessarily be upstream of a shaft driving the material in order that the helix shall be in stable equilibrium while moving; this comb is for instance placed between the upstream carrying shaft driven (directly or indirectly) by the material and the higher-speed downstream carrying shaft driving the material. This arrangement is particularly advantageous as it allows the comb to act as a means to lift the material (the helix which continues to surround the carrying shafts) out of the treatment agent whenever it is desired to stop the treatment without having to empty the volume of treatment agent (fluid, gas, atmosphere full of particles, for example).

The linear speed of the positive drive of the material at the outlet is controlled by an electrical or optical linkage system between the member at the outlet which actually extracts or drives out the material and the upstream carrying shaft. It is controlled to be equal with the peripheral speed of the latter shaft, itself equal to the input speed of the material, the upstream shaft being driven by the material, as said above. In this way, whether or not there is any slippage of material on the input member, the linear speeds of input and output of material remain constantly equal, and, as a result, the developed length of material in the volume (between entrance and exit) remains constant. Consequently, the upper limit of the growth of each loop, automatically controlled by contact with one wall sector of the volume, has as its counterpart a lower limit of shortening and naturally the construction of the machine takes account of this physical data, in order that no loop shall have, when it is shortest, a low point that will come out of the treatment agent nor approach dangerously the carrying shafts.

Another feature, rinsing by blowing, contributes to even more regular progressive movement of the helix of material in the apparatus. The supply of the material by capstan and satellite, as said above, solves the problems of the helical material having to pass over the entry wall of the volume, and the drawbacks entailed by this crossing. However, rinsing of the material at the exit of the volume is very often necessary to allow a subsequent treatment; in the prior art, the rinsing had to be done in a second volume or bath, frequently itself divided up by partitions. According to an optional feature of the invention, the material is rinsed and dried by blowing a rinsing fluid, for example compressed air, water, steam or a mixture of the three, over the whole of its external surface, this fluid being brought to a suitable temperature preferably higher than that of the treatment agent. Then the second volume, with the movement disturbances of the loops caused by the passing of its partitions, is made redundant. The fluid jet having the secondary effect of pushing the film of treatment agent, which the material brings with it by capillarity to its exit, back into the treatment volume, there appear an additional advantage of saving the treatment agent.

BRIEF DESCRIPTION OF THE DRAWINGS

FIG. 3 shows how these same are arranged when the elongated material, wire or coiled wire, is supplied by a grooved capstan and satellite.

FIG. 3A is a detail sectional view of the capstan of FIG. 3, taken in a plane identified by line A — A, of FIG. 3.

FIG. 4 is a simplified and enlarged view of a detail from FIG. 3 and shows a possible arrangement of the groove of the satellite which transmits the movement to an upstream shaft, and, FIG. 4A is a detail sectional view of a portion of the capstan of FIG. 4, taken in a plane identified by line B — B of FIG. 4.

DESCRIPTION OF THE PREFERRED EMBODIMENT

Figure 1:
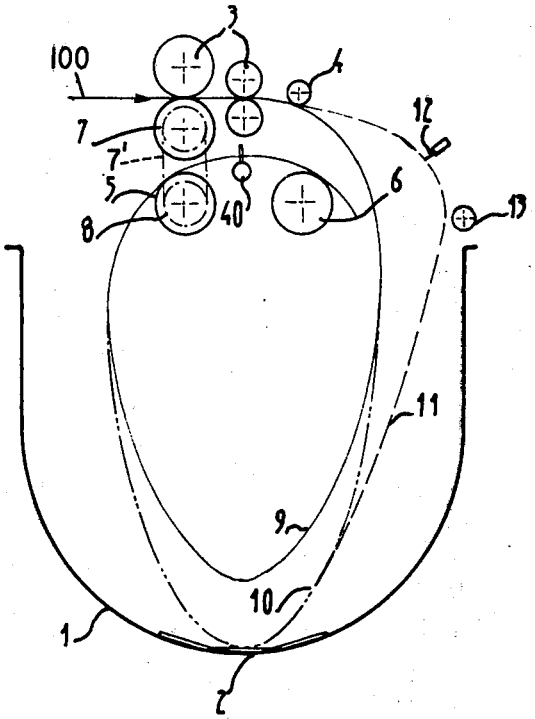
FIG. 1 is an end view, seen from the elongated material inlet side, of an embodiment of an apparatus according to the invention, the front wall of the treatment volume having been omitted.

On FIG. 1, a treatment volume is shown as a substantially semi-cylindrical tank or container 1 which is perpendicular to the plane of the figure; this figure is an end view with omission of the front wall of the tank. Lava slabs 2 are provided at the cylindrical bottom $\mathbf{1}_a$ of the tank 1.

For a treatment process which is known per se, an elongated material 100 is introduced within the tank 1 by means of a feeding arrangement including a set of drive rollers 3, followed by a bending arrangement consisting of a bending roller 4 to give a curvature to the material 100, and to form the first loop 9 of a helix.

Figure 2:
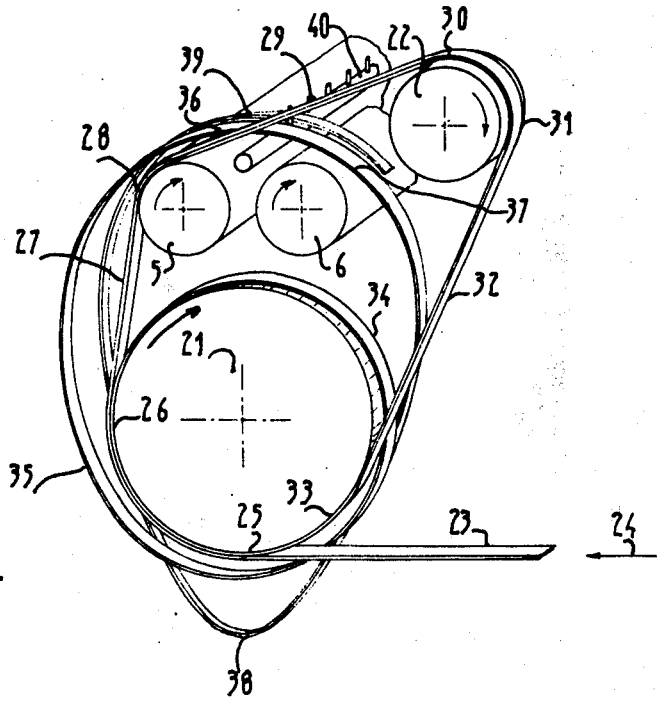
FIG. 2 is an perspective drawing of the entry of the elongated material (here a strip or band) and of units in movement; the treatment volume is not shown.

On FIG. 1 appears also a so-called upstream carrying shaft 5 and a so-called downstream carrying shaft 6; the former is intended to support the left end of loop 9 and the end of the further successive loops resulting of the passage of the material 100 on shafts 5 and 6 said material being helically formed as known per se and as best seen on FIG. 2.

On FIG. 1, a pair of toothed sprockets 7, 8 interconnected for synchronous rotation by a chain 7', transmits the rotation from the feed rollers 3 to the shaft 5.

The thickness of the material 100 helically disposed around and carried on the shafts 5 and 6 — whether band, tube, wire or coiled wire — has not been represented. In the latter three cases, the rollers 3 and 4 should have a groove in place of a flat rim. The material can be seen to take up its normal equilibrium shape as a catenary first loop 9 in the tank; a larger sequential loop 10 of the helix has also been shown just about to touch the slabs 2 on which it can usefully flatten itself, which stops it moving for a few moments. When the first loop 9 is thus formed, the upstream portion 11 shown in dashed line continues to be supplied by the set of rollers 3 and distorts until the presence of this said portion 11 is sensed at 12 by an appropriate device, as for example, a photoelectric cell, which stops the supply by the set of rollers 3. The purpose of roller 13 is to ensure that the portion 11 in any case does not spill over the edge of the tank 1.

FIG. 2 shows a feeding-in arrangement by means of a capstan 21 and a free satellite 22, (the upstream and downstream carrying shafts, 5 and 6, respectively, keeping the same reference numbers), of a metallic band, supplied, for example, by means of the unwinding of a reel (not shown), at 23 in the direction of the arrow 24. Between 25 and 26 on the rim of the capstan 21, the arriving portion 23 of the band grips a portion of the band 33 which has come back again underneath the first-mentioned portion after having taken a path from the capstan 21 which involves portions 27, 28 (over the upstream carrying shaft 5), 29, 30 and 31 over the satellite 22, and then downwardly at 32 back to capstan 21. The band thus takes up a curvature which, after path portions 34, 35, where it separates downwardly from the capstan behind the portion at 32, returns at 36 over and in supporting contact with the upstream shaft 5 axially spaced along the roller shaft from its first crossing point 28 of this shaft. It then bears at 37 on the downstream shaft 6 and forms the first loop of the helix (in the tank not shown), the lowest point of which is at 38; it then will go up again at 39 onto the upstream shaft 5 in order to begin the second loop, and so on. A comb 40 is placed between the shafts 5 and 6 and its first tooth $4_a$ is located so as to be interposed between the first and the second loop.

In FIG. 3 is shown schematically a feed-in arrangement by means of a capstan 21 and a free satellite 22 acting in conjunction with carrying shafts 5 and 6; shown also is the unput at 41 of a round-section material such as wire or tube, the diameter of which is not apparent. The whelp of the capstan is represented by a circle 42 and the bottom or root of a groove in its rim or periphery by a dotted circle 43, (see also FIG. 3A) whilst the profile of the groove of the capstan and the material on it are shown at 44 and 45, FIG. 3A which is a transverse section of the capstan 21 along the plane AA, FIG. 3. The material 41 bends in an outside layer in the groove of the capstan from 46 to 47, it then leaves it to go round the satellite from 48 to 49, and comes back as an inner layer in the capstan groove at 50; the two portions 68 and 69 between capstan and satellite being preferably crossed, it then becomes curved by the pressure of the portion 41 between 51 and 52, leaves the groove at 53 and from then is pulled by the portion which precedes it, passes under and behind the capstan at 54, then goes up again to be carried at 55 and 56 by the upstream and downstream shafts, 5 and 6 respectively, and forms the first catenary loop 57 in the tank (not shown), goes up again onto the shafts 5 and 6 and so on. At 58 and 59 have been drawn the external diameters of toothed sprockets which by means of a chain 60 transmit the movement from the free satellite 22, which is driven by the material 41, to the upstream carrying shaft 5 in such a way that the linear speed of the neutral line of the material 41 is the same on the satellite 22 as on the shaft 5.

FIGS. 4 and 4A are a partial schematic view showing to an enlarging scale the upstream carrying shaft 5, and the satellite 22 with a groove 61 FIG. 4A being a radial section of the satellite along section line BB, FIG. 4, shown here as having a half-angle $z$ at its apex, and the material, the neutral line of which has the same linear speed at 55 as at 58, is also shown whilst going round the two rotating members 5 and 22 without slippage, whatever the diameter of the round material. This figure shows, in this example, that it is easy to combine the following:

$\alpha$ — the diameters $2a$ of the shaft, 25 of the satellite (in the bottom of its groove) and $2r$ of the round material;

$\beta$ — the numbers of revolutions per minute N of the shaft and $n$ of the satellite;

$\gamma$ — the numbers of teeth $p$ of the transmission sprocket keyed on the shaft, and P of the sprocket keyed on the satellite, these sprockets not being shown, and finally, $\delta$ — the half angle $z$ of the groove of the satellite.

These are combined so that the material can give to the satellite an angular velocity (variable according to the diameter of the material and therefore its position in the groove) which, according to a suitable ratio between the numbers of teeth on the sprockets, is transmitted proportionally to the carrying shaft in such a way that the peripheral speed of the neutral line of the material remains exactly the same on the two rotating members.

At 61, it can be seen that the distance of the neutral line of the material from the bottom of the groove is $r/\sin z$. As a result, the equality of the peripheral speeds of the virtual points of the shaft 5 and of the satellite 22 which are on the neutral line of the material can be written thus:

$$N/n = \frac{S + r/\sin z}{a + r}$$

In addition, since the satellite 22 drives the shaft 5 by means of a couple of sprockets, the numbers of teeth of which are respectively $p$ and $P$, there is also the relation $N/n = P/p$ from
which it follows that:

$$P/p = \frac{S + r/\sin z}{a + r}$$

For all numbers $k \geqslant 1$ expressing the ratio of the diameters previously defined, $S/a = k$, the above equality is expressed thus:

$$P/p = \frac{ak + r/\sin z}{a + r}$$

which is always independant of $r$ if $k = 1/\sin z$, as in this case it becomes:

$$P/p = k\,\frac{a + r}{a + r} = k$$

which defines at the same time the ratio of the number of teeth of the sprockets, equal to that of the diameters, and the angle $z$.

Figure 5:
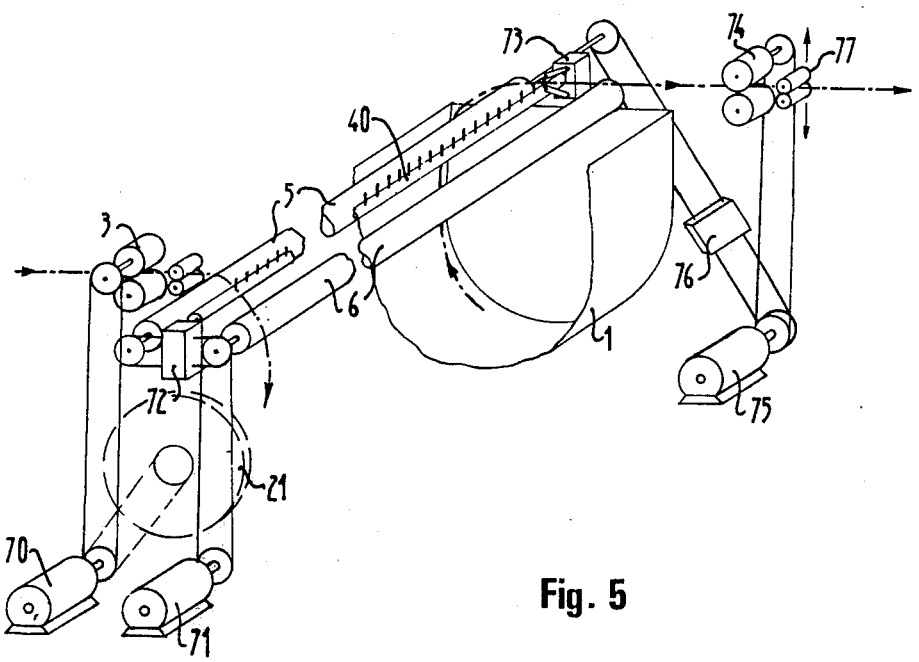
FIG. 5 shows a combination of drive motors and couplings for the drive means.

In FIG. 5 can be seen at 70 a drive motor for the entry member, being roller set 3 (as shown here) or capstan 21; at 71 an adjustable speed drive motor of the downstream shaft 6; at 72, (as an alternative to the motor 71), an adjustable speed regulator between the upstream shaft 5 and the downstream shaft 6: in either case the downstream shaft 6 runs at a higher peripheral speed than the shaft 5; at 73 a device for rinsing the material by directing on it a blast of fluid under pressure at its exit; at 74 an exit main set of rollers for the material, driven by a motor 75. A pair of rollers 77 can be adjusted in position in relation to the main set 74, transversely to the exit direction of the material, this allowing adjustment to the curvature of the material for its subsequent handling, whether by a device for treatment in tandem or a winding-up for interim storage on a predetermined reel diameter; at 76 an adjustable speed regulator for linking the motor 75 with the upstream shaft.

To put the apparatus into operation after a change of material, the following steps take place: first the apparatus is provided with an interchangeable entry unit suitable for the material, e.g; a set of cylinders or rollers for driving and bending, or capstan and satellite with flat rims or with grooves, sprockets and endless chains; then the filling of the treatment tank with the material by manually passing each loop into the comb and giving it a length approaching the maximum allowed by the tank walls, then the engaging of the material in the exit drive member and the approximate adjustment of the controls which decide the relative speeds of the movable members in relation to each other for the treatment to be done; during the initial adjustment, the peripheral speed of the downstream carrying shaft will be slightly greater than that of the upstream carrying shaft. Then the apparatus is set to a normal running speed and the behaviour of the loops is watched to see whether they regulate themselves by means of their stopping contact with a wall sector of the tank, after having momentarily followed their tendency to expand, or whether it would be better to shift a zone of expanded loops downstream, in order to re-absorb it more quickly, which can be done by increasing only the relative speed of the downstream carrying shaft.

The combination of all the means hereabove described has as its result a considerable increase in the treatment capacity of the apparatus in comparison with prior art, methods and devices, allowing one to reach and exceed linear speeds of material of about 100 yards per minute without the dimensions of the apparatus having therefore to be excessive.

Such an apparatus possibly applies to treatments of surfaces of partly worked materials in metallurgy, such as chemical or electrolytic pickling or deposition, or any other.

In the claims the expression "strip material" is to be interpreted as inclusive of material capable of being formed as an elongated ribbon, as well as material having a transverse section of regular geometrical form, such as round, square, etc.

I claim:

1. Apparatus for treatment of strip material by a fluid, comprising, a container for fluid, first and second strip-supporting, elongated shafts journaled for rotation over said container in spaced, side-by-side relation on parallel horizontal first and second axes, a comb fixed between and parallel with said shafts essentially in a plane determined by their uppermost elements and essentially coextensive therewith, said comb including upstanding teeth spaced therealong, and rotating means engaging and positively feeding the strip material at predetermined speed, into said container at one end of said shafts, thence upwardly over and in transverse contact with said shafts in a plurality of loops each and guided between consecutive pairs of teeth of said comb with each loop depending into said container for contact with treatment fluid therein.

2. The apparatus of claim 1, said rotating means including a first pair of driven feed rollers gripping the material therebetween, and means interconnecting said feed rollers and said first shaft, for rotation in predetermined timed relation.

3. The apparatus of claim 1, said material feeding means comprising a capstan journaled at one end of and below said shafts, for rotation on an axis parallel therewith, and guide means directing said material in a first pass about and in frictional contact with said capstan, thence upwardly and in a return pass to said capstan between said first pass and said capstan, in frictional contact with both.

4. The apparatus of claim 3, said guide means comprising a satellite journaled above and at said one end of said shafts for rotation about an axis parallel therewith, said first pass moving from said capstan upwardly and about said satellite in frictional contact therewith, thence downwardly to said capstan to form said second pass.

5. The apparatus of claim 4, said first and second passes of material crossing between said capstan and said satellite.

6. The apparatus of claim 4, and means connecting said first shaft and said satellite for simultaneous rotation at predetermined relative rates.

7. The apparatus of claim 1, and means interconnecting said shafts for conjoint rotation, and adjustable to vary the relation between the angular rates of rotation thereof.

8. The apparatus of claim 2, a second pair of rollers gripping said material between them to extract the same from said container, at the other end of said shafts, and power means connected to rotate said second pair of rollers.

9. The apparatus of claim 8, and a variable speed drive from said power means to said first shaft.

10. The apparatus of claim 1, and lava slabs secured to and within said container at areas thereof otherwise contacted by loops of material depending thereinto.

11. The apparatus of claim 4, said satellite having a peripheral groove having side walls diverging outwardly in axial section, thus spacing the neutral line of circular section material from the axis of rotation of the satellite, by a distance proportional to the diameter of the material, and driving said shafts at a constant ratio of angular speeds of rotation for all diameters of treated material.

* * * * *